US005875834A

United States Patent [19]

Brooks

[11] Patent Number: 5,875,834

[45] Date of Patent: Mar. 2, 1999

[54] BAFFLE INSERT FOR HEAT EXCHANGERS

[75] Inventor: Sean Terence Brooks, Mississauga, Canada

[73] Assignee: Long Manufacturing Ltd., Oakville, Canada

[21] Appl. No.: 64,217

[22] Filed: Apr. 22, 1998

[51] Int. Cl.[6] ..... F28D 1/03

[52] U.S. Cl. ..... 165/11.1; 165/140; 165/153; 165/176; 165/DIG. 465

[58] Field of Search ..... 165/11.1, 140, 165/153, 174, 176

[56] References Cited

U.S. PATENT DOCUMENTS

| | | | |
|---|---|---|---|
| 4,274,482 | 6/1981 | Sonoda | 165/153 |
| 4,327,802 | 5/1982 | Beldam | 165/153 |
| 4,936,381 | 6/1990 | Alley . | |
| 4,945,635 | 8/1990 | Nobusue et al. . | |
| 5,025,855 | 6/1991 | Hoshino et al. . | |
| 5,184,673 | 2/1993 | Hedman et al. | 165/153 |

FOREIGN PATENT DOCUMENTS

| | | | |
|---|---|---|---|
| 3834822 | 4/1990 | Germany | 165/153 |

*Primary Examiner*—Allen Flanigan
*Attorney, Agent, or Firm*—Barrigar & Moss

[57] ABSTRACT

Baffle inserts or shims are disclosed for controlling the flow circuiting in plate or tube type heat exchangers of the kind having a plurality of stacked, hollow plate pairs or tubes including mating end bosses or areas or spacers having communicating openings formed therein to form a manifold for the flow of fluid through the plate pairs. The baffle inserts are located between preselected adjacent end bosses in the area of the end bosses only, to define different flow circuits through the plate pairs or tubes without having to use specially shaped plates or inserting obstructions into the flow passages inside the plate pairs or tubes. A method of using the baffle inserts is disclosed in which the baffle inserts are inserted during preassembly of the heat exchanger prior to the brazing operation.

18 Claims, 3 Drawing Sheets

BAFFLE INSERT FOR HEAT EXCHANGERS

FIELD OF THE INVENTION

This invention relates to plate or tube type or heat exchangers of the kind having a plurality of stacked plate pairs or tubes, and in particular, to devices for changing the flow path or circuits inside the plate pairs or tubes.

BACKGROUND OF THE ART

Plate or tube type heat exchangers have been produced in the past which are made up of a plurality of stacked, hollow plate pairs or tubes for the flow of one fluid therethrough. The plate pairs or tubes often have end bosses located at opposed ends to form common flow manifolds for feeding fluid through the plate pairs or tubes. The plate pairs or tubes also allow for the transverse flow of another fluid, such as air, between the plate pairs or tubes, and cooling fins are often located in between the plate pairs or tubes to enhance the heat transfer co-efficient of the heat exchanger.

It is sometimes desirable to be able to force the fluid to flow along a predetermined path or circuit using a preselected combination or order of flow amongst the plate pairs or tubes. It is also desirable sometimes to divide the stack of plate pairs or tubes into separate modules, each having its own inlet and outlet, so that there is, in effect, multiple heat exchangers or modules in one unitary structure.

One way of accomplishing these desired results in the past has been to use special or unique plates or tubes for some of the plate pairs or tubes, where the end bosses in the special plates or tubes are closed. Another way is to use special blank plates between or inside some of the plate pairs or tubes. A difficulty with these methods, besides causing inefficient flow obstructions, is that several unique or odd-shaped components are necessary which make it difficult to assemble the heat exchangers and result in many errors being made by positioning the wrong components in the wrong locations. The result is many defective or inoperative heat exchangers being produced.

The present invention eliminates the need for special plates or tubes and unwanted flow obstructions yet easily accommodates different flow circuit configurations by using a simple baffle inserted between the plate or tube end bosses prior to brazing the heat exchanger.

SUMMARY OF THE INVENTION

According to one aspect of the invention, there is provided an improved plate or tube type heat exchanger of the type having a plurality of stacked, hollow plate pairs or tubes including mating end boss areas having communicating openings formed therein to form flow manifolds for the flow of fluid through the plate pairs or tubes. The improvement comprises at least one discrete baffle insert located between a preselected pair of mating end boss areas. The baffle insert is located generally in the end boss area only.

According to another aspect of the invention, there is provided a method of redirecting the flow of fluid in a plate type heat exchanger of the type having a plurality of stacked, hollow plate pairs or tubes including mating end bosses or end boss areas having communicating openings formed therein to form flow manifolds for the flow of fluid through the plate pairs or tubes. The method comprises the steps of loosely assembling the stacked plate pairs or tubes, inserting a baffle insert between a preselected pair of mating end bosses, the baffle insert being located generally in the area of the end bosses only. Also, the plate pairs or tubes and baffle insert are then brazed together to form a heat exchanger.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
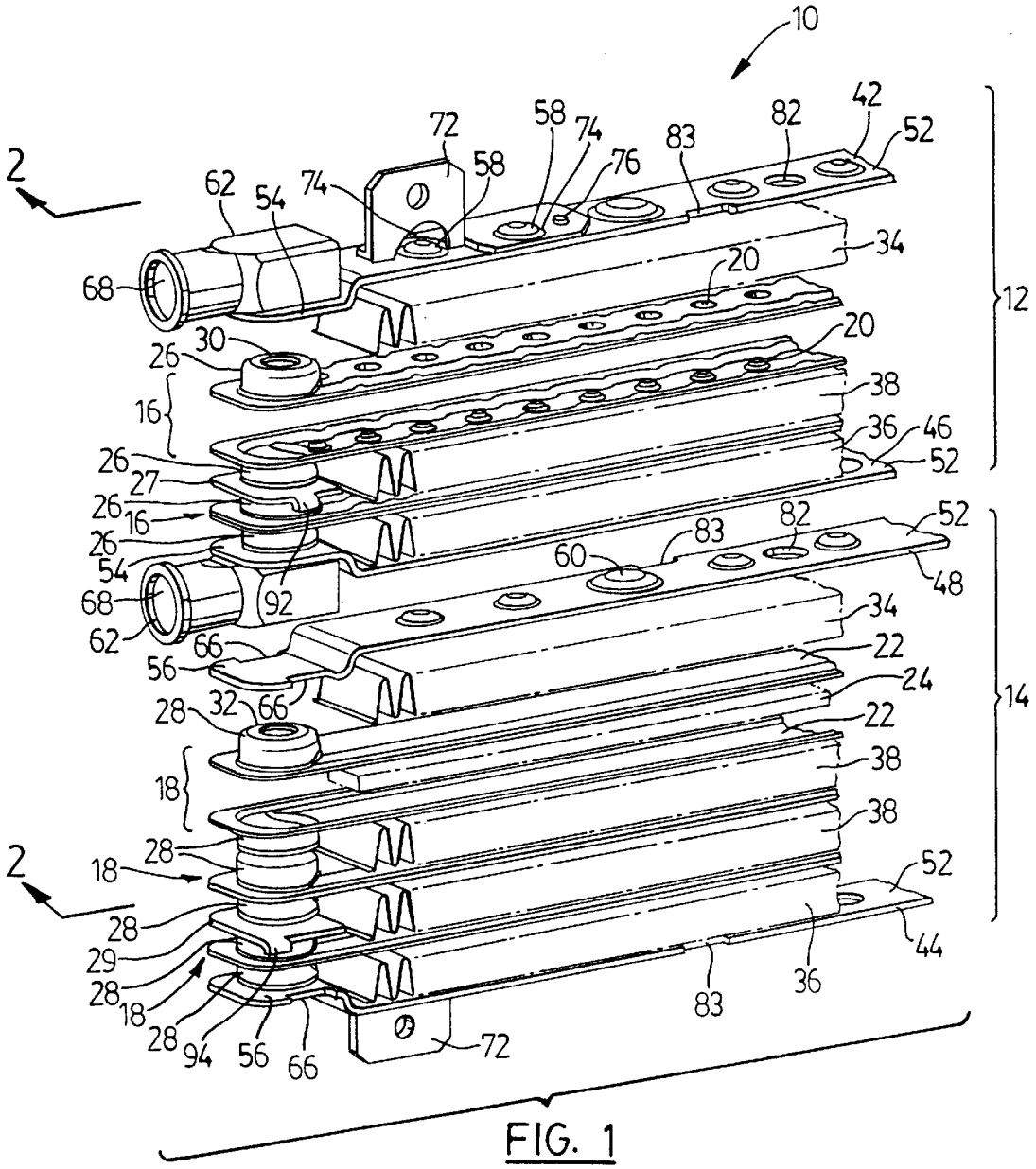
FIG. 1 is an exploded perspective view of a sample plate and fin type heat exchanger employing preferred embodiments of baffle inserts according to the present invention.
Figure 2:
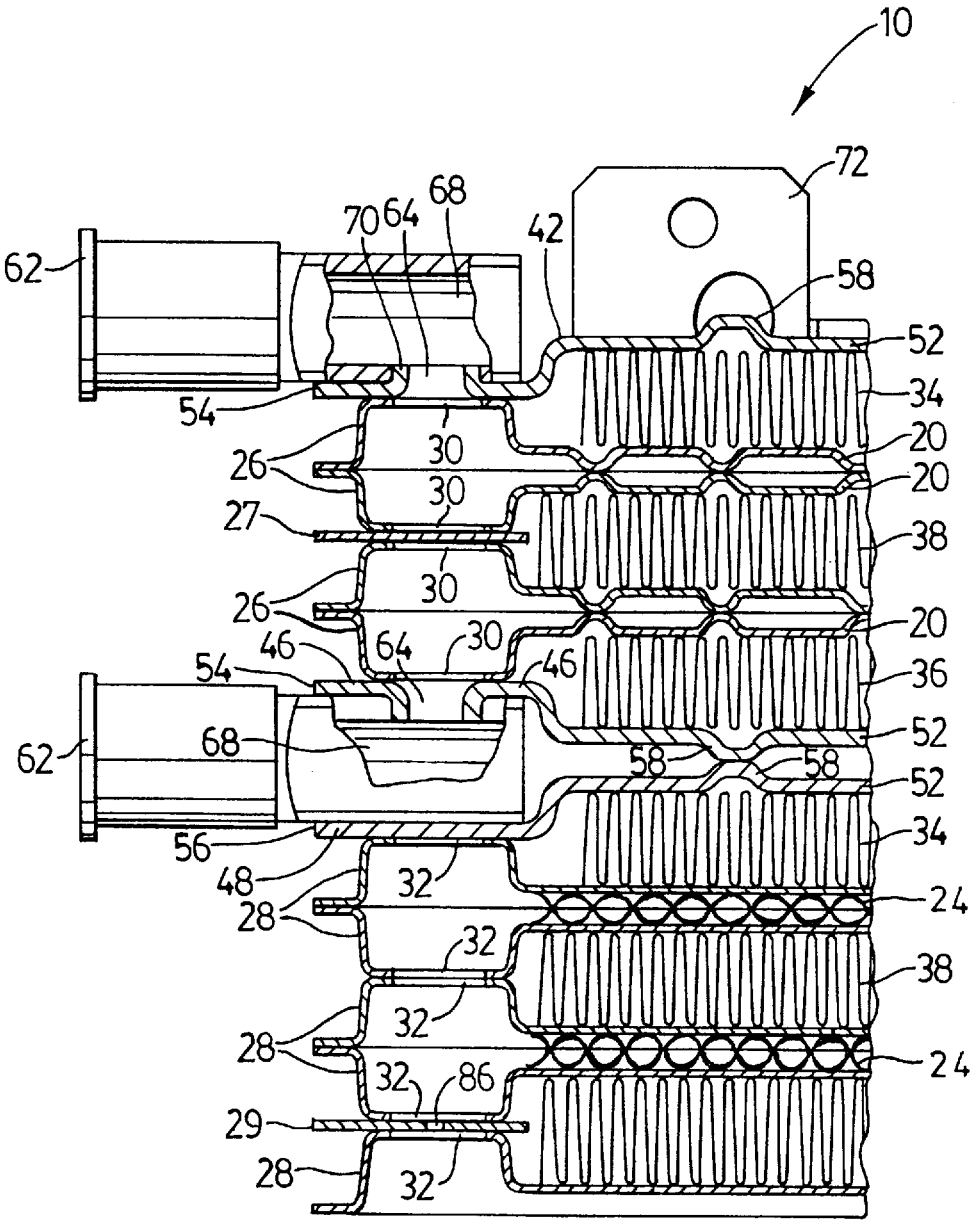
FIG. 2 is an elevational view, partly broken away, of the upper left corner of the heat exchanger of FIG. 1 taken in the direction of arrows 2—2.

Referring firstly to FIGS. 1 and 2, an example of a plate and fin heat exchanger employing the present invention is generally indicated by reference numeral 10. However, heat exchanger 10, per se, is not considered to be part of the present invention. Any type of plate type heat exchanger can be used with the present invention, whether or not it has fins or just mating plate pairs. Also, heat exchangers having tubes instead of plate pairs can be used in the present invention as well. For the purposes of this disclosure, plate pairs or tubes are considered to be equivalent and may sometimes be referred to as flow conduits or channels. Heat exchanger 10 includes two modules 12 and 14, each containing a separate flow circuit for accommodating a different fluid. For example, module 12 could be used to cool automotive transmission oil or fluid, and module 14 could be used to cool automotive engine oil. It will be appreciated, however, that heat exchanger 10 could be used to heat different fluids as well. Also, although two modules 12, 14 are shown, any number of additional modules could be incorporated into a single heat exchanger 10.

Heat exchanger 10 is formed of a plurality of stacked, hollow plate pairs or conduits 16, 18. Plate pairs 16 are formed of mating plates that have inwardly joined dimples 20 and are thus called dimpled plate pairs 16. Plate pairs 18 are formed of plates that have flat centre sections 22 and expanded metal turbulizers 24 located inside the plate pairs. Plate pairs 18 are thus called flat plate pairs. Each of the plate pairs 16, 18 has mating end bosses or end boss areas 26, 28. These end bosses have communicating openings 30, 32 to form an aligned flow manifold for the flow of fluid through the plate pairs. Baffle inserts 27, 29 close the openings 30, 32 to provide a particular flow circuit inside the modules, as will be described further below.

Heat exchanger 10 includes a top fin 34 located on top of the stacked plate pairs 16, and a bottom fin 36 located below the stacked plate pairs 18. Module 12 also has a bottom fin 36 and module 14 has a top fin 34. Intermediate fins 38 are located between the plate pairs. All of the fins 34, 36 and 38 extend between their respective end bosses 26 and 28 located at the opposed ends of the adjacent plate pairs.

As mentioned above, plate pairs 16, 18 and fins 34, 36 and 38 are not considered to be part of the present invention, per se. The use of baffle inserts 27, 29 is part of the present invention. Any type of plate pair or tube, either dimpled or of the flat turbulizer type, and any type of fins or even no fins, can be used in the present invention. It is required for the present invention, however, that the plate pairs or tubes have some type of end boss areas or spaces for the insertion of baffle inserts 27, 29. In other words, there is no need in heat exchanger 10 to use special or unique plates or tubes, or to put anything inside the plate pairs or tubes to interfere with the flow therethrough.

Module 12 has a top mounting or end bracket 42, and module 14 has a bottom mounting or end bracket 44. Module 12 also has a bottom mounting or end bracket 46 and module 14 has a top mounting or end bracket 48. Actually, all of the mounting brackets 42, 44, 46 and 48 are identical.

Mounting brackets 42, 44 have a planar central portion 52 and opposed offset end portions 54, 56 located in a plane parallel to and spaced from central portion 52. As seen best in FIG. 2, planar central portions 52 of top and bottom mounting brackets 42, 46 are in contact with respective top and bottom fins 34, 36. Similarly, for module 14, planar central portions 52 of top and bottom mounting brackets 48, 44 are in contact with respective top and bottom fins 34, 36 for this module. Offset end portions 54, 56 are in contact with an adjacent end boss 26 or 28 as the case may be.

Planar central portions 52 also have spacing projections in the form of dimples 58, 60 extending transversely in a direction opposite to that of offset end portions 54, 56.

As seen best in FIG. 2, the offset end portions 54 of mounting brackets 42, 46 are formed with a flow orifice 64, and the other offset end portions 56 are blank or closed. Offset end portions 56 are formed with peripheral notches 66 (see FIG. 1) for error proofing the assembly of heat exchanger 10 and for indicating the fluid flow circuit inside the heat exchanger, as will be described further below. It will be appreciated also that peripheral notches 66 could be provided on offset end portions 54 instead of offset end portions 56 to accomplish the same results.

End fittings 62 include internal flow passages 68 that communicate with flow orifices 64 in offset end portions 54. Actually, end fittings 62 have transverse openings which are aligned with flow orifices 64, and a staking operation is used to attach or preassemble end fitting 62 to offset end portions 54 as indicated by the formed flanges 70 in FIG. 2.

As seen also in FIGS. 1 and 2, heat exchanger 10 includes attaching or attachment brackets for mounting the heat exchanger in a desired location. Attachment brackets 72 can be any configuration desired, but they preferably have circular or semi-circular openings 74 for accommodating dimples 58 to help align attachment brackets 72 during the assembly of heat exchanger 10. Attachment brackets 72 are temporarily attached to mounting brackets 52, 54 by rivets 76, or by a type of swaging or staking operation referred to by the trademark TOGGLE LOCK.

Mounting brackets 42, 44, 46 and 48 are also formed with alignment holes 82 and peripheral notches 83 to help align the components during the assembly of heat exchanger 10.

Figure 3:
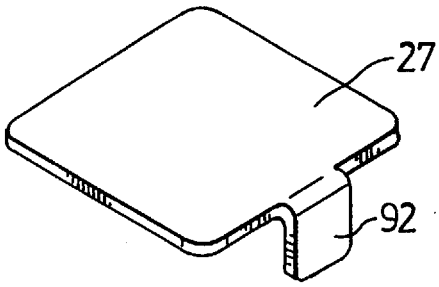
FIG. 3 is a perspective view of one type of baffle insert used in the heat exchanger of FIG. 1.
Figure 4:
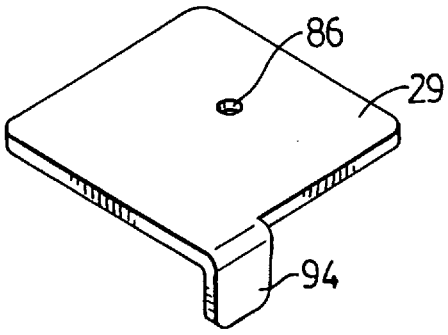
FIG. 4 is a perspective view of another type of baffle insert used in the heat exchanger of FIG. 1.

Referring next to FIGS. 3 and 4, it will be seen that baffle inserts 27, 29 are basically discrete, rectangular, planar inserts with rounded corners. Baffle inserts 27, 29 are generally about the size in area of end boss areas 26, 28, so that they do not interfere significantly with the flow of air through heat exchanger 10. In other words, they can be slightly larger or smaller than the end boss areas, but they do not extend into the area between the plate pairs 16, 18 which are normally occupied by fins 34, 36 and 38.

Baffle insert 27 completely closes the communicating openings 30 in the mating end bosses 26. Baffle insert 29 has a calibrated bypass opening 86 which allows a small, predetermined amount or partial bypass flow to pass therethrough. This bypass flow allows for cold flow bypass and may also increase the general flow rate through the plate pairs or tubes or reduce the internal pressure drop in heat exchanger 10, if these characteristics are desired in heat exchanger 10.

Figure 5:
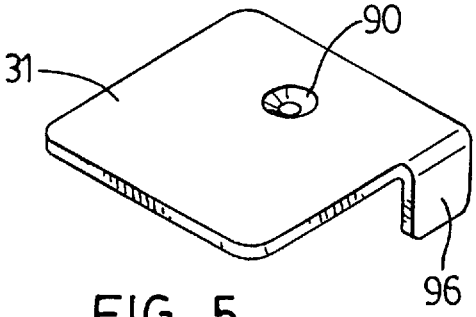
FIG. 5 is a perspective view of yet another embodiment of a baffle insert according to the present invention.

Baffle insert 31 shown in FIG. 5 is similar to baffle insert 29, but bypass orifice 90 is in the form of a cone or a venturi. Other orifice shapes and sizes can be used as well for the bypass openings or orifices in baffle inserts 29, 31.

Baffle inserts 27, 29 and 31 have indicator tabs or flanges 92, 94, 96 to indicate or distinguish the types of baffle plates used in heat exchanger 10 after the heat exchanger is manufactured, because then it would not otherwise be possible visually to determine the flow circuits in heat exchanger 10. It will be noted that flanges 92, 94, 96 are in three locations: left, centre and right. By using combinations of these flange positions, up to 7 permutations or combinations of flanges can be formulated. Some of these other combinations can be used to indicate orifice 86 or 90 of different sizes or shapes, or perhaps the material thicknesses of the baffle inserts, as desired. Other types of indicators, such as peripheral notches can be used as well, but flanges 92, 94, 96 are preferred because they help to align the baffle inserts during the assembly of heat exchanger 10.

Baffle inserts 27, 29, 31 are preferably formed of brazing clad aluminum, but they can be formed of plain aluminum or other material that is brazeable to aluminum. The thickness of the inserts is less than the thickness required to significantly affect the spacing between the plate pairs, but more than is required to withstand the internal design pressure of heat exchanger 10. The preferred range is between 0.003 inches (0.08 mm) and 0.024 inches (0.61 mm), and preferably about 0.010 inches (0.25 mm), for most aluminum plate or tube type heat exchangers currently being made. However, it may be possible to make the baffle inserts as thick as 0.040 or 0.050 inches (100 to 127 mm) if they can be assimilated in the brazing process as described further below.

In the assembly of heat exchanger 10, the desired flow circuits or passes are first determined. For example, in module 12 in the heat exchanger shown in FIG. 1, it is desired that fluid enter one of the end fittings 62, pass through an inlet flow orifice 64 in one of the offset end portions and into one of the end boss openings 30. The fluid then flows the length of one of the plate pairs 16. The flow is reversed at the opposite end of the plate pairs and comes back to exit through outlet orifices communicating with the other end fittings 62. Either end fitting 62 can be used as a flow inlet fitting, the other end fitting 62 being the flow outlet fitting. In module 14, the end fittings 62 are located to the right (not shown). Fluid flow passes through one end fitting 62 in a similar manner to travel along one or more of the plate pairs 18. The flow is then reversed, because the end bosses 28 form a manifold, and the fluid flows back to exit through another end fitting 62. Baffle insert 29 allows some bypass flow to pass through one of the plate pairs 18. It will be appreciated, however, that the location of baffle inserts 27, 29 in heat exchanger 10 is just an illustrative example. The baffle inserts and end fittings 29 can be located in any desired configuration to give the flow circuits desired.

Having decided upon a desired flow circuit for heat exchanger 10, the desired number of plate pairs 16, 18, fins 34, 36 and 38 and mounting brackets 42, 44, 46 and 48 are loosely stacked together, the end fittings 62 and mounting bracket orientations being chosen, as desired. Baffle inserts 27, 29 or 31 are then inserted between preselected end bosses to produce the desired flow circuits. The complete assembly is then permanently joined by brazing or soldering to complete the heat exchanger. The brazing or soldering operation softens or deforms the end boss material allowing the baffle inserts to be assimilated or accommodated into the structure and still give good bonds between the mating components of heat exchanger 10 and not significantly affect the spacing between the hollow plate pairs or tubes.

It will be appreciated by those skilled in the art that by swapping the mounting brackets end for end and turning end fittings 62 upside down, that any flow configuration or circuit can be provided in heat exchanger 10.

Although mounting brackets 46, 48 are shown in FIG. 1 having a flow orifice offset end portion 54 located adjacent to a closed offset end portion 56, one of the mounting brackets can be turned end for end. In this case, the adjacent flow orifice offset end portions 54 could have an end fitting 62 with a transverse hole that passes right through the fitting to communicate with both orifices 64 allowing flow to go into or out of two adjacent modules simultaneously. It will also be appreciated that heat exchanger 10 can be made having any number of modules. Further, end fittings 62 can be orientated in other directions, such as transverse to the plate pairs.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A plate or tube type heat exchanger of the type having a plurality of stacked, hollow plate pairs or tubes including mating end boss areas having communicating openings formed therein to form flow manifolds for the flow of fluid through the plate pairs or tubes, the improvement comprising: at least one discrete baffle insert located between a preselected pair of mating end boss areas, said baffle insert being located generally in the end boss area only.

2. A heat exchanger as claimed in claim 1 wherein baffle insert completely closes the communicating openings between the mating end bosses.

3. A heat exchanger as claimed in claim 1 wherein the baffle insert includes a calibrated bypass orifice to allow a predetermined partial flow of fluid through the baffle.

4. A heat exchanger as claimed in claim 3 wherein the baffle insert has an indicator means for indicating the amount of bypass flow that can pass therethrough.

5. A heat exchanger as claimed in claim 4 wherein the indicator means is a preselected type of transverse flange.

6. A heat exchanger as claimed in claim 4 wherein the indicator means is a preselected type of notch formed on the periphery of the baffle insert.

7. A heat exchanger as claimed in claim 1 wherein the plate pairs are formed of aluminum and wherein the baffle insert is formed of other material brazeable thereto.

8. A heat exchanger as claimed in claim 1 wherein the plate pairs and the baffle insert are formed of brazing clad aluminum.

9. A heat exchanger as claimed in claim 7 wherein the thickness of the baffle insert is less than the thickness required to significantly affect the spacing between the hollow plate pairs, but more than is required to withstand the design pressure of the heat exchanger.

10. A heat exchanger as claimed in claim 9 wherein the baffle insert thickness is between 0.003 inches (0.08 mm) and 0.024 inches (0.61 mm).

11. A heat exchanger as claimed in claim 3 wherein said orifice is in the form of a cone or venturi.

12. A method of redirecting the flow of fluid in a plate or tube type heat exchanger of the type having a plurality of stacked, hollow plate pairs or tubes including mating end bosses or end boss areas having communicating openings formed therein to form flow manifolds for the flow of fluid through the plate pairs or tubes, the method comprising the steps of: loosely assembling the stacked plate pairs or tubes; inserting a baffle insert between a preselected pair of mating end bosses, said baffle insert being located in the area of said end bosses only; and brazing the plate pairs or tubes and baffle insert together to form a heat exchanger.

13. A method of redirecting the flow of fluid as claimed in claim 12 wherein the plate pairs or tubes are formed of brazing clad aluminum and wherein the baffle insert is formed of plain aluminum.

14. A method of redirecting the flow of fluid as claimed in claim 12 wherein the plate pairs and the baffle insert are formed of brazing clad aluminum.

15. A method of redirecting the flow of fluid as claimed in claim 12 wherein the brazing step is conducted such that the mating end bosses deform to accommodate the thickness of the baffle insert so as not to significantly affect the spacing between the hollow plate pairs.

16. A method of redirecting the flow of fluid as claimed in claim 13 wherein the brazing step is conducted such that the mating end bosses deform to accommodate the thickness of the baffle insert so as not to significantly affect the spacing between the hollow plate pairs.

17. A method of redirecting the flow of fluid as claimed in claim 14 wherein the brazing step is conducted such that the mating end bosses deform to accommodate the thickness of the baffle insert so as not to significantly affect the spacing between the hollow plate pairs.

18. A method of redirecting the flow of fluid as claimed in claim 12 and further comprising the step of inserting additional similar baffle inserts between other preselected pairs of mating end bosses prior to the brazing step to redirect the flow of fluid in a serpentine fashion through the heat exchanger.

* * * * *